United States Patent [19]

Forest

[11] Patent Number: 4,797,539

[45] Date of Patent: Jan. 10, 1989

[54] ALCOHOLIC CONCENTRATION INDICATOR

[76] Inventor: Guy A. Forest, 942, Nicole-Lemaire, Boucherville, Qc, Canada, J4B 3G5

[21] Appl. No.: 60,236

[22] Filed: Jun. 10, 1987

[51] Int. Cl.[4] ..... G06C 3/00

[52] U.S. Cl. ..... 235/85 R; 235/78 R; 235/88 R

[58] Field of Search ..... 235/78 R, 78 F, 78 M, 235/85 R, 88 R, 88 F, 88 M, 61 M, 61 J, 84; 116/223, 224, 316, 317, 318, 308, 309; 368/233

[56] References Cited

U.S. PATENT DOCUMENTS 3,668,866 6/1972 Lund ..... 116/308

4,680,453 7/1987 Pugh ..... 235/78 R

*Primary Examiner*—L. T. Hix

*Assistant Examiner*—David M. Gray

*Attorney, Agent, or Firm*—Roland L. Morneau

[57] ABSTRACT

An alcoholic concentration indicator comprising three superposed circular discs adapted to rotate about a common axis. The lower disc displays on its margin a scale of alcohol concentration indicia and over its central surface a multiplicity of numbers representing the number of drinks consumed. The middle disc has a series of aperture across a diameter to provide usual access to the numbers appearing on the central portion of the first disc. Each aperture is identified by a weight of a human body. A scale of consecutive numbers also appears to represent the number of hours elapsed since the first drink. The top disc is transparent and displays two pointers: one pointer for the alcoholic indicia and the other pointer for the time elapsed since the first drink. The desired results are obtained by visualizing the number corresponding to the number of drinks through the aperture corresponding to the weight of the user. Then one pointer of the transparent disc is aligned with the number corresponding to the number of hours elapsed since the first drink. The other pointer become automatically aligned with the estimated alcoholic concentration in the user's blood.

6 Claims, 5 Drawing Sheets

ALCOHOLIC CONCENTRATION INDICATOR

BACKGROUND OF THE INVENTION

1. Field of the Invention

The present invention is directed to a dial-type indicator adapted to estimate the probable alcohol level in the blood of an average person. This evaluation is based on the sexe and the weight of the person in addition to the quantity of alcohol absorbed and the elapsed time since the beginning of his first drink.

2. Prior Art

Canadian Pat. No. 942,267 to H. Z. Lund corresponding to U.S. Pat. No. 3,668,866 is directed to a dial-type indicator for a purpose similar to the present invention. The concept of Lund's device rests entirely on the adjustment of a variable arc defining a scale of alcohol concentration. This arc needs to be adjusted according to the weight of the user. For each drink the user must rotate the disc displaying the scale of alcohol concentration over the distance defined by the arc. The final reading of the alcohol concentration has required as many rotation through the limit of this arc as the number of drinks absorbed. The central disc displays a time scale. The zero value of the scale of the alcohol concentration is ajusted with the central disc according to the true time of the first drink. With each drink, the user rotates the disc displaying the alcohol concentration inside the boundries of the above mentioned arc. At the end of each drink, the user can read the residual value of alcohol in the blood in line with the central disc displaying the actual time.

The combination of discs and scales requires and elaborate manipulation which may exceed the ability of some users.

SUMMARY OF THE INVENTION

The present invention comprises three superposed discs including a first one displaying on its periphery a scale representing the concentration of alcohol in the blood and inside this periphery a multiplicity of small circles displaying a number representing the number of drinks absorbed. The second disc is provided with a set of apertures across a diameter and adapted to allow vision of the small circles on the first disc. Each of these apertures is identified by a weight of a human body. The second disc also carries a time scale. The third disc is made of transparent material and carries two adjusting marks such as pointing arrows to establish a correspondence between the time on the second disc and the alcohol concentration on the first disc. The operation consists of two steps. For the first step, the user aligns the aperture corresponding to his weight with the circle corresponding to the number of drinks. The second step consists in pointing one arrow of the third disc with the time scale corresponding with the time elapsed since the beginning of the first drink. The user can then read, in line with the second arrow, the residual concentration of alcohol in the blood.

DETAILED DESCRIPTION OF THE INVENTION

Figure 1:
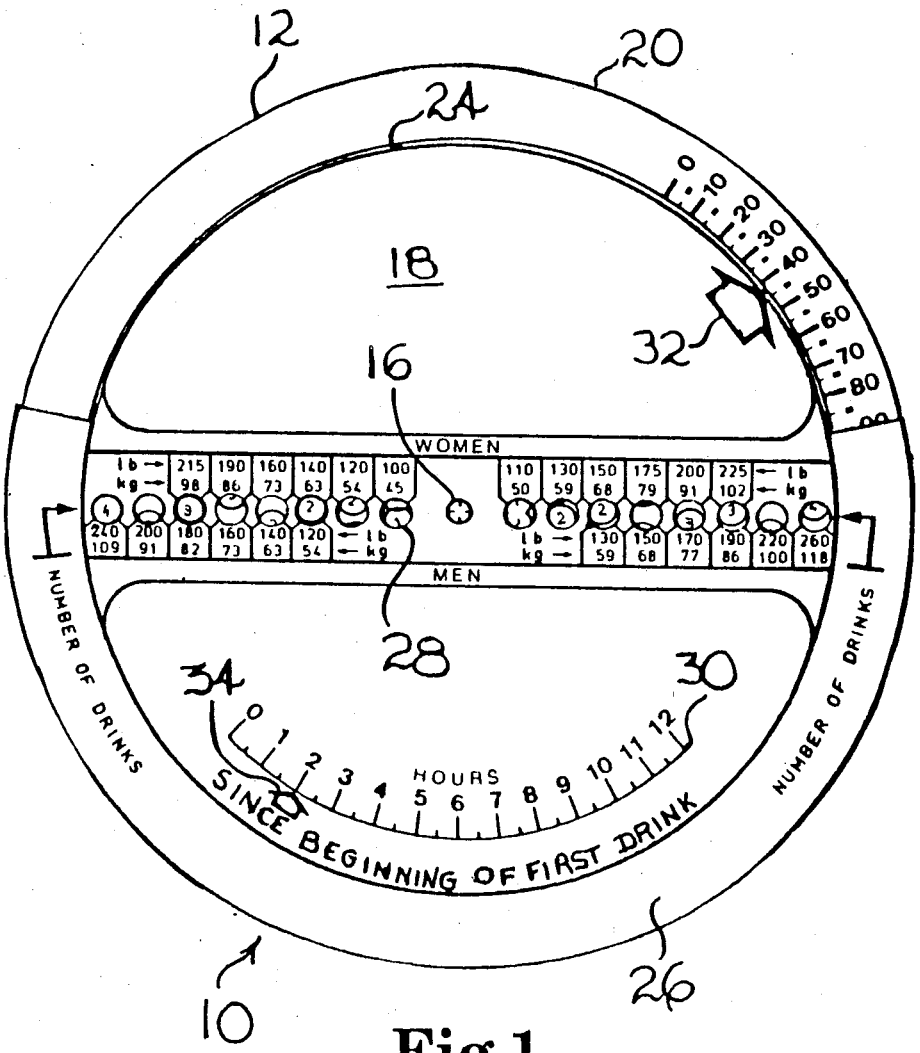
FIG. 1 is a front view of the three discs superposed according to the invention.
Figure 2:
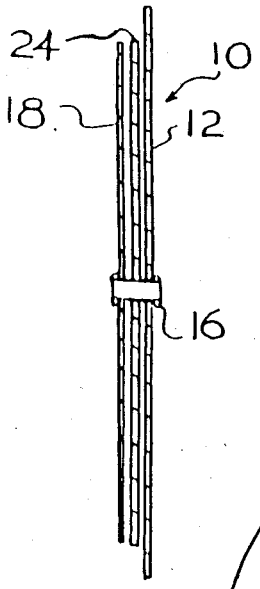
FIG. 2 is a vertical cross-sectional view of the discs shown in FIG. 1, FIGS. 3, 4 and 5 are front views of the first, second and third disc respectively.

FIGS. 1 and 2 show an alcoholic concentration indicator 10 mounted for usual operation. It includes a circular lower disc 12 and a second disc 24 rotatably mounted relative to each other about an axle 16 in a superposed manner. A transparent disc 18 is also similarly mounted over the disc 14.

Figure 3:
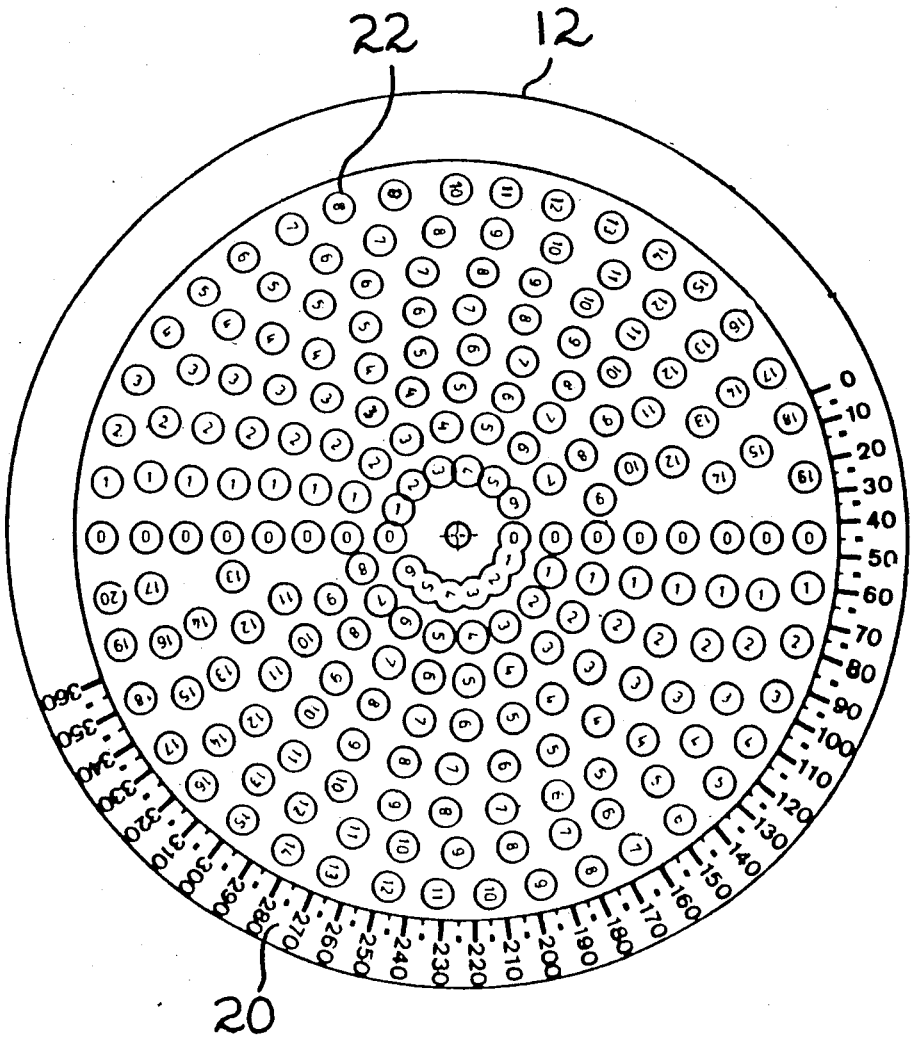

FIG. 3 represents the lower disc 12 with a scale 20 on part of its peripheral margin. This scale 20 is constituted of indicia representing alcohol concentrations which may be detected in the blood of a person. In the circle, inside this margin, a multiplicity of numbers, such as 22, are displayed along concentric circles and radially corresponding to the indicia on the scale 20. These numbers 22 represent the numbers of drinks the user has absorbed. Each number 22 is surrounded by a circle to identified them more neatly and clearly.

Figure 4:
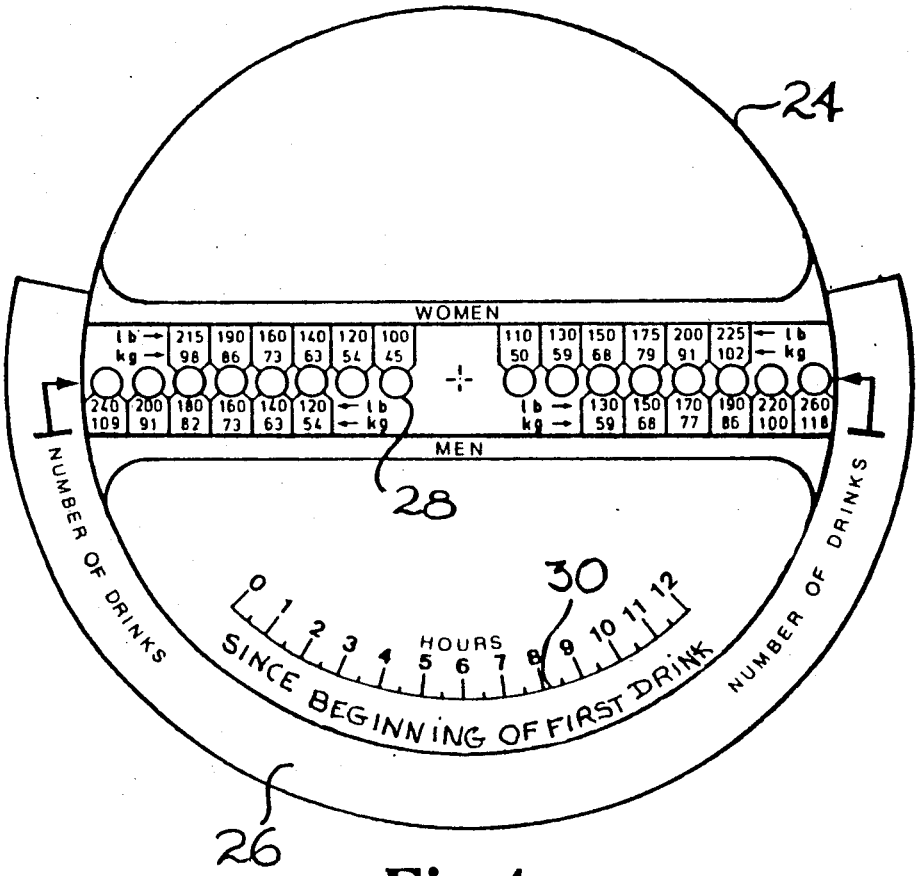

FIG. 4 represents the second disc 24 having a series of adjacent apertures 28 along a diameter of the disc 24. Each aperture 28 has a diameter allowing the user to see one of the numbers 22 on the lower disc 12, as seen in FIG. 1. The disc 24 has a marginal ledge 26 on part of its periphery. The ledge is used to help rotate the disc 24 and to provide written information for the user. Both ends of the ledge 26 form shoulders 50 and 51 which may have a use as seen later. Each aperture 28 carries, adjacent its periphery, an identification relative to the weight of a person. As illustrated in FIG. 4, the identification may refer to the weight of men and women separately considering that the absorbtion of alcohol does not give the same results for both sexes.

The weight may also be specified in pounds and kilograms. Although the drawing illustrates, in the disc 24, a series of adjacent apertures 28, these apertures could be substituted by an elongated slot covering the same width across the diameter of the disc 24 as the apertures 28. However, apertures are preferred, to help maintain the rigidity of the disc 24 and to facilitate the selective reading of the numbers 22.

Another scale 30 appears in one of the semi-circular area of the disc 24. A series of consecutive numbers along an arc of a circle represents the number of hours elapsed since the beginning of the first drink.

Figure 5:
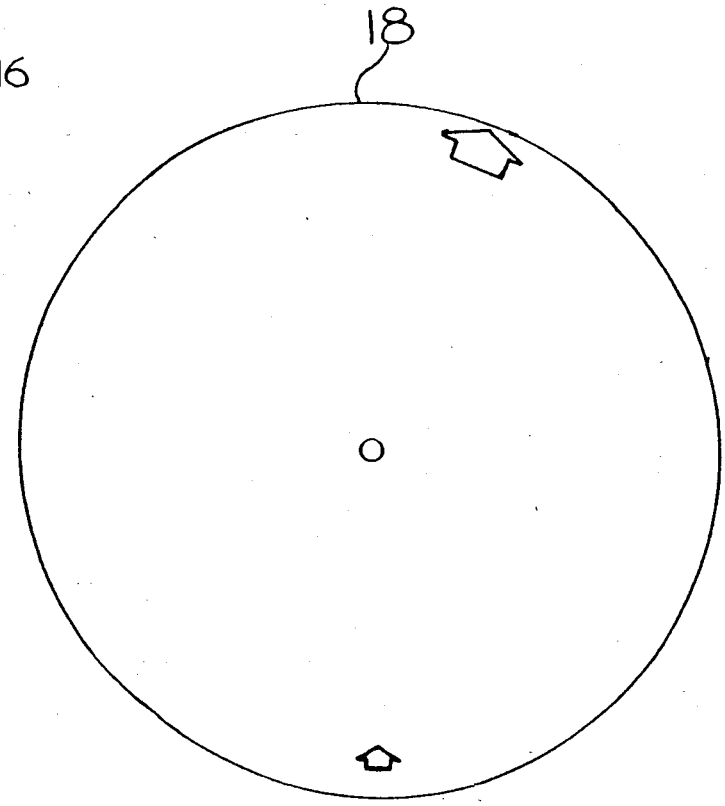

FIG. 5 illustrates a transparent disc 18 to be superposed over the disc 14 as shown in FIGS. 1 and 2. The disc 28 displays two arrows 32 and 34. The large arrow 32 is located near the periphery so as to point at the concentration scale while the small arrow 34 points at scale 30.

The indicia 20 appearing on the peripheral margin of the disc 12 express the alcohol concentration in milligrams per 100 milliliters of blood.

After the user has located, on disc 24, the aperture 28 corresponding to his weight and sex, he rotates the disc 12 to align one of the numbers 22 corresponding to the number of drinks he has absorbed. He then rotates the transparent disc 18 to point the small arrow 34 in line with the number in scale 30 corresponding to the numbers of hours elapsed since he had his first drink. In this position, the large arrow 32 points automatically towards the residual value of alcohol in the blood appearing on scale 20.

Because, some people cannot equate the values represented on scale 20 with their own degree of ebriety, that scale can be shaded or colored to identify safe and dangerous zones and, in between, the legal limit for driving a vehicle.

Figure 6:
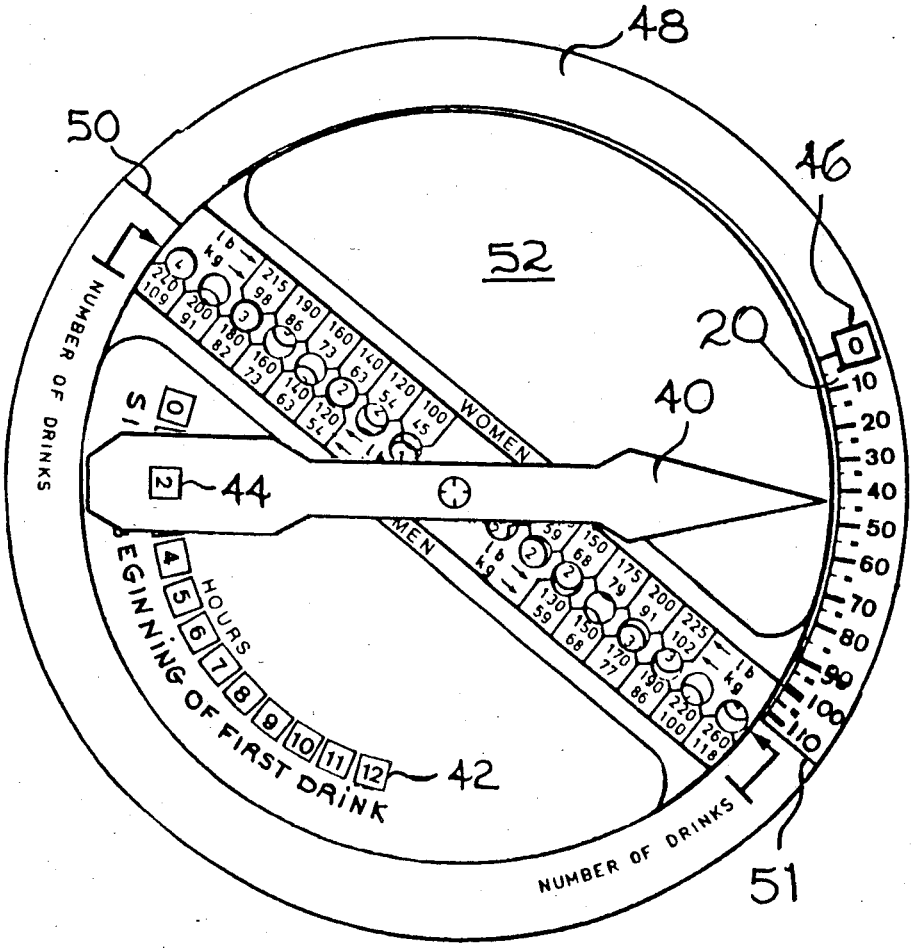
FIG. 6 is a front view of another embodiment of the invention comprising two discs and an arrow.

FIG. 6 illustrates another embodiment wherein the transparent disc is replaced by an arrow 40. Another modification consists in locating the scale 42, representing the numbers of hours elapsed since the first drink, along an arc appearing under the arrow 40. The arrow 40 is provided with a hole 44 in line with the scale 42 so as to make the numbers of that scale visible through the arrow.

It is therefore possible to obtain the same correspondence between scales 42 and 20 as between scales 30 and 20.

An additional feature of the indicator shown in FIG. 6 is a stopper 46 which protrudes from the surface of the lower disc 48 displaying the scale 20. The shoulders 50 and 51 of the second disc 52 abuts against the stopper 46 and limits the travel of the second disc relative to the lower disc 48 and maintains the second disc 52 always correctly oriented relative to the lower disc 48.

The set of scales and figures printed on the discs described in this invention are based on the observations made by E. M. P. Widmark, and the formula resulting from them as described in Drink, Drugs and Driving by H. J. Walls and Alistair R. Brownlie, 1985. It should be obvious that the indicator hereinafter claimed is not restricted to these numerical results.

I claim:

1. An alcoholic concentration indicator comprising at least two superposed concentric circular discs adapted to rotate about their axis relative to one another, the lower one having on, at least part of its peripheral margin, a scale representing alcohol concentration indicia and a multiplicity of numbers concentrically displayed inside said margin, the said numbers representing the number of drinks consumed, the second disc having a dimension adapted to cover the portion of said lower disc inside said margin and being provided with an elongated slot across a diameter of said second disc, the width of said slot corresponding substantially to the size of the said numbers displayed on the lower disc, the said second disc displaying along the edges of said slot a series of figures representing the weight of human bodies and also displaying a series of numbers along a circumferential portion thereof, the said series of numbers representing the number of hours elapsed since the beginning of the first drink, means rotating about the axis of said superposed discs for the double and simultaneous identification of a number of said series of numbers and a portion of said scale, whereby the said discs are rotated relative to one another to match one of said figures representing a weight with one of said numbers on the lower disc appearing through said slot, the said means being rotated to identify simultaneously a number in said series of numbers and an alcohol concentration indicium on said scale.

2. An indicator as recited in claim 1, wherein said elongated slot is characterized by a series of adjacent apertures, each of said apertures covering an area substantially corresponding to one of the numbers of said multiplicity of numbers.

3. An indicator as recited in claim 1, wherein the said means rotating about an axis comprises an arm member radially extending over said disc, the said arm member having an opening therethrough for displaying one of said series of numbers.

4. An indicator as recited in claim 1, wherein the said means rotating about an axis comprises a partly transparent disc mounted over said second disc, the said transparent disc displaying two identifying marks on its surfaces for allowing the said double identification.

5. An indicator as recited in claim 1, wherein the said second disc has a marginal ledge around a portion of its circumference to extend substantially over the same diameter as the lower disc.

6. An indicator as recited in claim 5, wherein the said ledge forms two shoulders at each end thereof, an abutment secured to the said lower disc about its periphery, the said shoulders being adapted to limit the rotation of the second disc when touching said abutment.

* * * * *